United States Patent [19]

Pandolph

[11] 4,130,177

[45] Dec. 19, 1978

[54] LADDER CLIMBER'S SAFETY DEVICE

[76] Inventor: James E. Pandolph, 11970 SW. 174 St., Miami, Fla. 33177

[21] Appl. No.: 816,376

[22] Filed: Jul. 15, 1977

[51] Int. Cl.[2] ..... E06C 7/18; A62B 1/16

[52] U.S. Cl. ..... 182/8; 182/133

[58] Field of Search ..... 182/133, 134, 135, 136, 182/8, 9

[56] References Cited

U.S. PATENT DOCUMENTS

| | | | |
|---|---|---|---|
| 1,613,836 | 1/1927 | Kuhlmann | 182/134 |
| 3,019,852 | 2/1962 | Soderberg | 182/134 |
| 3,156,465 | 11/1964 | Jacobi | 182/136 |
| 3,348,632 | 10/1967 | Swager | 182/8 |
| 3,968,858 | 7/1976 | Vollan | 182/136 |

*Primary Examiner*—Reinaldo P. Machado

*Attorney, Agent, or Firm*—Ernest H. Schmidt

[57] ABSTRACT

A ladder climber's safety device for use with stationary ladders of the type having side rails of rectangular cross-sectional configuration includes hand grip members slidable along each rail and loosely interconnected by a cable removably attachable to the safety belt of the climber. The handle grip members include opposed gripping teeth adapted to engage their respective ladder rails when rotated downwardly towards the front of the ladder for preventing free downward movement thereof, and roller wheels adapted to engage the rail edges when the handle grip members are pushed in the upward direction to permit free movement thereof along the rails as controlled by the climber in climbing or descending the ladder.

4 Claims, 5 Drawing Figures

LADDER CLIMBER'S SAFETY DEVICE

This invention relates to ladders and is directed particularly to a novel and improved safety device for use in climbing industrial ladders of the type used in the maintainence and repair of tall structures such as water towers, smoke stacks, antenna masts and the like.

Various types of ladder climbing safety devices preventing accidental falling while climbing tall ladders have heretofore been devised. Commonly, such devices include a rugged safety belt worn about the waist of the climber, used in association with a cable or the like adapted to be repeatedly secured in one way or the other to the ladder as the climber ascends and descends. Such safety devices heretofore known, however, are deficient in various respects, principally in that they either require continual manipulation of the safety connector device along the ladder structure during ascent or descent, or, if gripping action of the safety line or cable is automatically effected during ascent or descent, they involve the use of specially designed ladder rails, resulting in a comparatively expensive installation. It is, accordingly, the principal object of my invention to provide a novel and improved ladder climber's safety device that obviates the deficiencies of such devices heretofore known.

A more particular object of the invention is to provide a ladder climber's safety device that not only makes it unnecessary for the climber to remove his hands from the device while climbing or descending the ladder, but which also assists the climber by providing hand grip means substantially easier to use and more reliable than the use of the ladder rungs as in ordinary climbing.

Another object of the invention is to provide a ladder climbing safety device of the above nature which requires no special cooperative ladder rails, and can therefore be used with ladders having rails of ordinary rectangular cross-sectional shape.

Yet another object of the invention is to provide a ladder climber's safety device which will be easy to install and remove from the ladder, which will operate on curved ladders, which can readily be transferred from ladder to ladder as required, which will be light in weight for ease of operation and compact and dependable in operation.

Other objects, features and advantages of the invention will be apparent from the following description when read with reference to the accompanying drawings. In the drawings, wherein like reference numerals denote corresponding parts throughout the several views.

Figure 1:
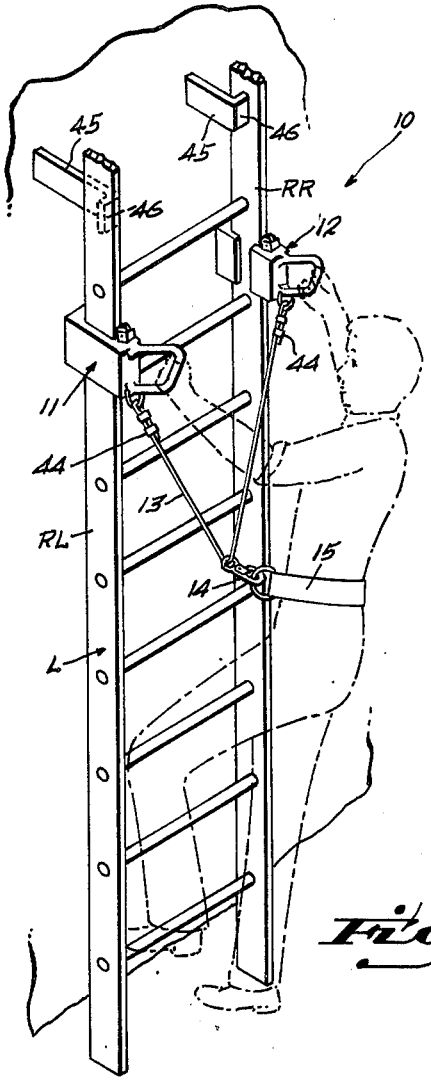
FIG. 1 illustrates, in perspective, a stationary ladder equiped with a ladder climber's safety device embodying the invention, shown in use.
Figure 2:
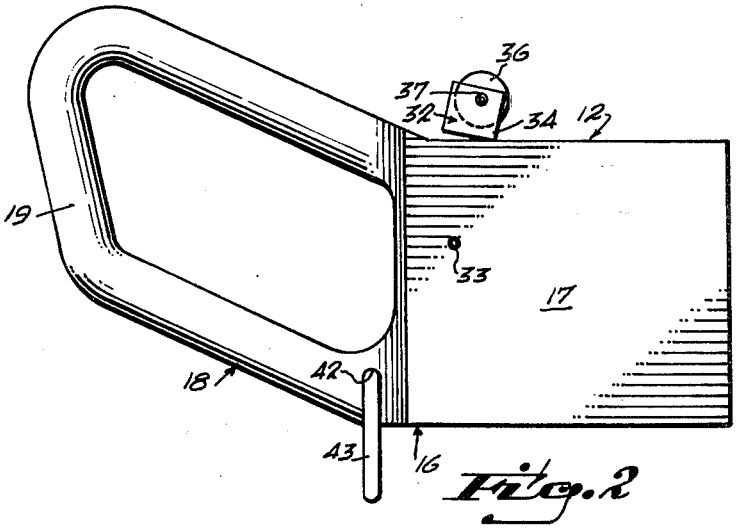
FIG. 2 is an outside elevational view of one of the sliding lock handle members comprising the invention, shown separately.
Figure 3:
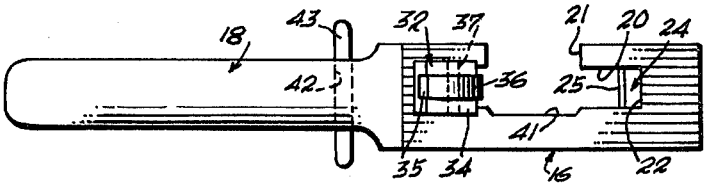
FIG. 3 is a top plan view thereof.
Figure 4:
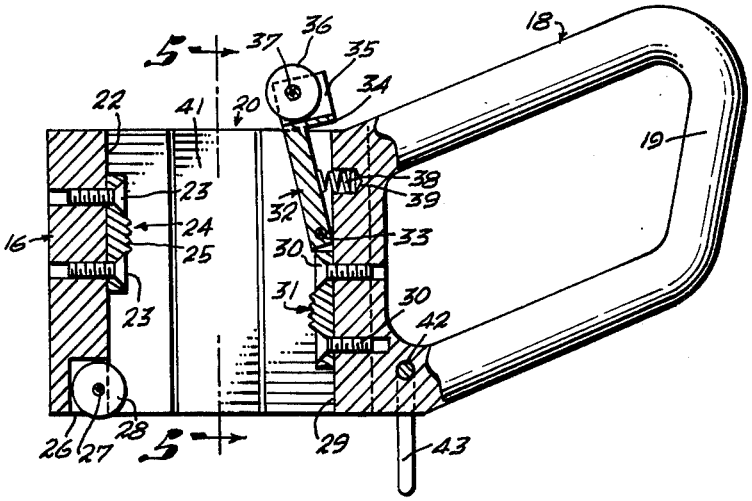
FIG. 4 is an inside elevational view of the sliding lock handle illustrated in FIG. 2, with portions broken away to reveal constructional details.
Figure 5:
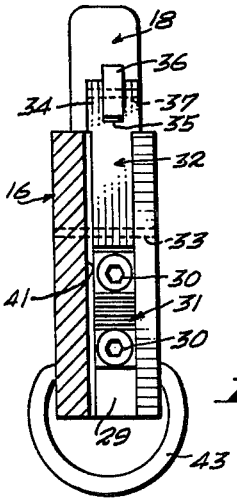
FIG. 5 is a vertical cross-sectional view taken along the plane indicated at 5—5 of FIG. 4 in the direction of the arrows.

Referring now in detail to the drawings, reference numeral 10 in FIG. 1 designates, generally, a preferred form of ladder climber's safety device embodying the invention, shown in use in association with a stationary vertical ladder. The ladder climber's safety device 10 comprises a pair of left and right hand sliding lock handle members 11, 12, interconnected by a cross connecting cable 13 carrying slidable therealong, a safety hook member 14 adapted to be releasably attached to the safety belt 15 secured about the waist of the climber. Since the left and right hand sliding lock handle members 11 and 12 are mirror images of one another, only one, right-hand sliding lock hand member 12, is described herein in detail with reference to FIGS. 2 through 5. As illustrated, sliding lock handle member 12 comprises a body member 16 preferably integrally formed of cast metal, having a substantially rectangular ladder rail grip portion 17. Extending upwardly and outwardly of one vertical end of rail grip portion 17 is an angular loop portion 18, the outermost side 19 of which serves as a handle the use of the device in climbing as is hereinafter described. As best illustrated in FIGS. 3 and 4, the rail grip portion 17 of the body member 16 is formed with a narrow, rectangular, top-to-bottom through opening 20 which, at the inside of said body member, communicates with a central top-to-bottom through opening 21, for the purpose hereinafter appearing. The vertical inner end wall 22 of the opening 20 which is opposite the handle 19, has secured thereagainst, near the upper end thereof as by machine screws 23, an elongated, hardened steel rail grip member 24 having a plurality of laterally-extending, inwardly-projecting angular teeth 25. The vertical inner end wall 22, at the lower end thereof, is formed with a right-angular recess 26, open at the bottom, within which is journalled, as by journal pin 27, a steel roller wheel 28. As best illustrated in FIG. 4, the roller wheel 28 projects inwardly of the top-to-bottom through opening 20 to a distance somewhat short of the inward projection of the teeth 25 of rail grip member 24.

The vertical inner end wall 29 opposite vertical inner end wall 22, near the lower end thereof, has secured thereagainst, as by machine screws 30, a toothed rail grip member 31, identical with the rail grip member 24 described above. An elongated roller wheel carrier member 32 is pivotally journalled at one end directly above the rail grip member 31, as by journal pin 33, and extends outwardly of the upper end of the top-to-bottom through opening 20 to terminate in integrally-formed, somewhat enlarged head portion 34 vertically recessed and open at the top as indicated at 35. Received within the recess 35 is a steel roller wheel 36 journalled with respect to head portion 34 of roller wheel carrier member 32 as by journal pin 37. As illustrated in FIG. 4, a compression spring 38 fitted within a blind bore 39 in inner end wall 29 behind elongated roller wheel carrier member 32 abuttingly urges the roller wheel carrier member 32 in the inward or counter-clockwise direction as illustrated in FIG. 4. As seen in FIG. 3, the inner side wall 40 of top-to-bottom through opening 20 is formed along its length with a shallow recess 41 for clearance of outside rung protrusions as the sliding lock handle member 12 is moved along a ladder rail.

The loop portion 18 of the sliding lock handle member 12, near the lower innermost corner of body member 16, is provided with a transverse through opening 42 within which is captured a D-ring 43 to which is attached one end of the cross connecting cable 13 as by use of cable clamps 44. The other end of the cable is connected with the corresponding D-ring of companion sliding lock handle member 11.

Referring to FIG. 1 it will be seen that the ladder climber's safety device 10 is designed for use with stationary ladders L of the type having side rails of rectangular cross-sectional configuration. The size of the slide lock handle members 11 and 12 is such that the lateral spacing between the inner end walls 22 and 29 thereof is somewhat greater than the front-to-back width of associated ladder rails RL and RR, the thickness of said rails being slightly less than the side-to-side width of the top-to-bottom through openings 20 in said sliding lock handle members. With further reference to FIG. 1 it will be seen that the brackets 45 securing the ladder rails to the supporting structure are formed with right-angular portions 46 which are welded or otherwise secured against inside central portions of their respective ladder rails. As such they are inwardly offset with respect to the insides of the rails to provide for assembly of the sliding lock handle members to the rails by passing them down over the upper ends thereof.

In use the safety hook member 14 slidable loosely along the cross connecting cable 13 will be attached to the climber's safety belt 15, as illustrated in FIG. 1 and the climber will grip the left and right hand sliding lock handle members 11 and 12. In climbing, the sliding lock handle members 11, 12 will be alternately pushed upwardly along their respective ladder rails ahead of the climber as he steps up along the ladder rungs. In this connection it will be noted that the climber will not remove his hands from the sliding lock handle members as in ordinary ladder climbing. In operation, it will be understood that the spring pressed roller wheel carrier member 32 serves to constrain the respective sliding lock handle members 11 and 12 to rotate in the clockwise direction, as illustrated in FIG. 1, whereat the rail grip members 24 and 31 will be brought into abutting engagement with the back and front edges, respectively, of the ladder rails RL and RR, thereby preventing their free downward sliding movement. The additional clockwise stress imposed by the climber in pulling downward upon the sliding lock handle members 11, 12 while climbing accentuates the gripping action of the rail grip members 24, 31 thereby enhancing the locking action. As soon as the climber begins to push upwardly on one of the sliding lock handle members 11 or 12, however, it will be moved counterclockwisely with respect to its ladder rail so that the roller wheels 28 and 36 are brought into rolling contact with respect to the outer and inner edges of the rail while, at the same time, the grip members 24 and 31 will be removed from contact therewith. This permits easy sliding of the sliding lock handle member up its ladder rail while the supporting weight of the climber is carried by the other sliding lock handle member. In descending the ladder, the climber will use the gripping loop portions 18 to alternately rotate the sliding lock handle members 11, 12 in the counterclockwise direction and maintain them in such position to enable step-by-step lowering along the ladder. It will be understood that since such an active manipulation of the lock handle members is required to descend the ladder, there is no danger of free slippage thereof downwardly along the ladder rails in such a manner as might place the climber in any danger. It will further be understood that if for any reason the climber should lose his grip on the sliding lock handle members 11, 12, the downward stress imposed thereon by the cable 13 supporting the climber's safety belt 15 will similarly cause the lock handle members to lock in place along their respective ladder rails, thereby eliminating any possibility of the climber falling while climbing down the ladder.

While I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. A ladder climber's safety device for use with stationary ladders of the type having side rails of rectangular cross-sectional configuration comprising, in combination, a pair of sliding lock handle members, a top-to-bottom through opening in each of said sliding lock handle members for the sliding reception therein of one each of the side rails of the stationary ladder, manual grip means extending laterally outwardly of each of said sliding lock handle members, a cable loosely interconnecting said sliding lock handle members and permitting independent relative sliding movement of said sliding lock handle members along their respective ladder rails, said sliding lock handle members each comprising means for frictionally gripping their respective ladder rails to prevent downward sliding movement therealong when said sliding lock handle members are rotated downwardly with respect to their ladder rails towards the front of the ladder for preventing free downward movement thereof, means controlled by the manual rotation of said sliding lock handle members in the opposite direction with respect to their ladder rails to release said gripping action and permit free upward movement of said sliding lock handle members along their respective rails as controlled by the climber in climbing or descending the ladder, said manual gripping means extending forewardly with respect to the ladder rails along which they are slidingly disposed, said sliding lock handle member gripping means comprising toothed rail grip members fixed with respect to front and back wall portions, respectively, of said top-to-bottom through opening, near lower and upper end portions thereof, respectively, the width of said top-to-bottom through opening being somewhat greater than the width of the front to back width of the associated ladder to permit said rotative rocking motion of said sliding lock handle member with respect thereto, said gripping action release means comprising a pair of roller wheels journalled within said top-to-bottom through opening for protrusion therewithin beyond surfaces defined by said front and back wall portions, respectively, of said top-to-bottom through opening, near upper and lower end portions thereof, respectively, said lower roller wheel being so disposed and of such size as to preclude its contact with the associated ladder rail when the sliding lock handle member is frictionally gripping the rail, said upper roller wheel being journalled at the upper end of an elongated carrier member the lower end of which is pivotally journalled within said top-to-bottom through opening, and means resiliently urging said roller wheel carrier member in the inward direction with respect to said top-to-bottom through opening for yieldingly urging said sliding lock handle members in said downwardly rotated positions.

2. A ladder climber's safety device as defined in claim 1, wherein said manual grip means comprises an upwardly angled loop member integrally formed with said sliding lock handle member.

3. A ladder climber's safety device as defined in claim 2, wherein said toothed rail grip members are removably secured with respect to said sliding lock handle members.

4. A ladder climber's safety device as defined in claim 3, wherein said cable interconnecting means comprises a ring member captured in a through opening in a lower end portion of each of said angled loop members, the ends of said cable being looped through one each of said rings.

* * * * *